US008160467B2

(12) United States Patent
Zona et al.

(10) Patent No.: US 8,160,467 B2
(45) Date of Patent: Apr. 17, 2012

(54) APPARATUS AND METHOD FOR PRINT APPARATUS ROTATIONAL ASSEMBLY CLEANING BLADE ADJUSTMENT

(75) Inventors: Michael F. Zona, Holley, NY (US); Aaron Michael Burry, Ontario, NY (US); Bruce Earl Thayer, Webster, NY (US); Peter Paul, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 333 days.

(21) Appl. No.: 12/431,261

(22) Filed: Apr. 28, 2009

(65) Prior Publication Data

US 2010/0272460 A1 Oct. 28, 2010

(51) Int. Cl.
*G03G 15/00* (2006.01)
*G03G 21/00* (2006.01)

(52) U.S. Cl. ..... 399/71; 399/350

(58) Field of Classification Search ..... 399/71, 399/350, 351
See application file for complete search history.

(56) References Cited

U.S. PATENT DOCUMENTS

| | | | | |
|---|---|---|---|---|
| 4,465,362 | A * | 8/1984 | Tohma et al. | 399/351 X |
| 5,278,620 | A | 1/1994 | Godlove | |
| 5,463,455 | A * | 10/1995 | Pozniakas et al. | 399/350 |
| 7,184,674 | B2 * | 2/2007 | Satoh et al. | 399/350 X |
| 2008/0260410 | A1 * | 10/2008 | Kato | 399/71 |

FOREIGN PATENT DOCUMENTS

| | | | |
|---|---|---|---|
| JP | 56-047079 | * | 4/1981 |
| JP | 2005-202026 | * | 7/2005 |

* cited by examiner

*Primary Examiner* — Sandra Brase
(74) *Attorney, Agent, or Firm* — Ronald E. Prass, Jr.; Prass LLP

(57) ABSTRACT

An apparatus (100) and method (200) for print apparatus rotational assembly cleaning blade adjustment is disclosed. The apparatus can include a printer rotational transport assembly (110) configured to transport a substance in a printer. The apparatus can include a cleaning blade (120) coupled to the printer rotational transport assembly and a cleaning blade sensor (130) coupled to the cleaning blade, where the cleaning blade sensor can be configured to sense cleaning blade stress condition information. The apparatus can include a controller (140) coupled to the cleaning blade and the cleaning blade sensor, where the controller can be configured to adjust cleaning blade parameters of operation based on the sensed cleaning blade stress condition information.

19 Claims, 4 Drawing Sheets

APPARATUS AND METHOD FOR PRINT APPARATUS ROTATIONAL ASSEMBLY CLEANING BLADE ADJUSTMENT

BACKGROUND

Disclosed herein is an apparatus and method for print apparatus rotational assembly cleaning blade adjustment.

Presently, image output devices, such as printers, multifunction media devices, xerographic machines, ink jet printers, and other devices produce images on media sheets, such as paper, substrates, transparencies, plastic, cardboard, or other media sheets. To produce an image, marking material, such as toner, ink jet ink, or other marking material, is applied to a media sheet to create an image on the media sheet. A fuser assembly then affixes or fuses the image to the media sheet by applying heat and/or pressure to the media sheet.

Various substances are transported on rotational members in an image output device to generate the images on the media sheets. Substances include marking materials, such as toner and ink jet ink, lubricating fluids, and release agents. For example, marking material, lubricating fluid, or release agent is transported on rolls, belts, drums, intermediate belts, or other rotational members during an image production process. Excess substance, debris, and other particles or other substances are cleaned off the rotational members using cleaning blades that clean the surface of the rotational member as it rotates. Unfortunately, a cleaning blade is subject to wear as it cleans the rotational member surface and the cleaning blade must eventually be replaced. This problem is exacerbated when a cleaning blade is not properly adjusted, which results in faster wear and more frequent replacement of the cleaning blade.

Thus, there is a need for an apparatus and method for print apparatus rotational assembly cleaning blade adjustment.

SUMMARY

An apparatus and method for print apparatus rotational assembly cleaning blade adjustment is disclosed. The apparatus can include a printer rotational transport assembly configured to transport a substance in a printer. The apparatus can include a cleaning blade coupled to the printer rotational transport assembly and a cleaning blade sensor coupled to the cleaning blade, where the cleaning blade sensor can be configured to sense cleaning blade stress condition information. The apparatus can include a controller coupled to the cleaning blade and the cleaning blade sensor, where the controller can be configured to adjust cleaning blade parameters of operation based on the sensed cleaning blade stress condition information.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

The embodiments include an apparatus for print apparatus rotational assembly cleaning blade adjustment. The apparatus can include a printer rotational transport assembly configured to transport a substance in a printer. The apparatus can include a cleaning blade coupled to the printer rotational transport assembly and a cleaning blade sensor coupled to the cleaning blade, where the cleaning blade sensor can be configured to sense cleaning blade stress condition information. The apparatus can include a controller coupled to the cleaning blade and the cleaning blade sensor, where the controller can be configured to adjust cleaning blade parameters of operation based on the sensed cleaning blade stress condition information. The apparatus can include an actuator coupled to the cleaning blade, where the actuator can provide the physical implementation of the adjustment to the cleaning blade parameters of operation.

The embodiments further include a method for print apparatus rotational assembly cleaning blade adjustment in an apparatus having a printer rotational transport assembly configured to transport a substance in a printer and a cleaning blade coupled to the printer rotational transport assembly, where the cleaning blade can be configured to remove a substance from the printer rotational transport assembly. The method can include transporting a substance on a surface of the printer rotational transport assembly and removing at least a portion of the substance from the printer rotational transport assembly surface using the cleaning blade. The method can include sensing cleaning blade stress condition information and adjusting cleaning blade parameters of operation based on the sensed cleaning blade stress condition information.

The embodiments further include an apparatus for print apparatus rotational assembly cleaning blade adjustment. The apparatus can include a printer rotational transport assembly configured to transport a substance in a printer. The apparatus can include a cleaning blade coupled to the printer rotational transport assembly, where the cleaning blade can be configured to remove at least a portion of the substance from the printer rotational transport assembly. The apparatus can include a cleaning blade sensor coupled to the cleaning blade, where the cleaning blade sensor can be configured to sense high frequency cleaning blade variation. The apparatus can include a cleaning blade operation controller coupled to the cleaning blade and coupled to the cleaning blade sensor, where the cleaning blade operation controller can be configured to adjust cleaning blade parameters of operation based on the sensed high frequency cleaning blade variation to reduce the high frequency cleaning blade variation.

Figure 1:
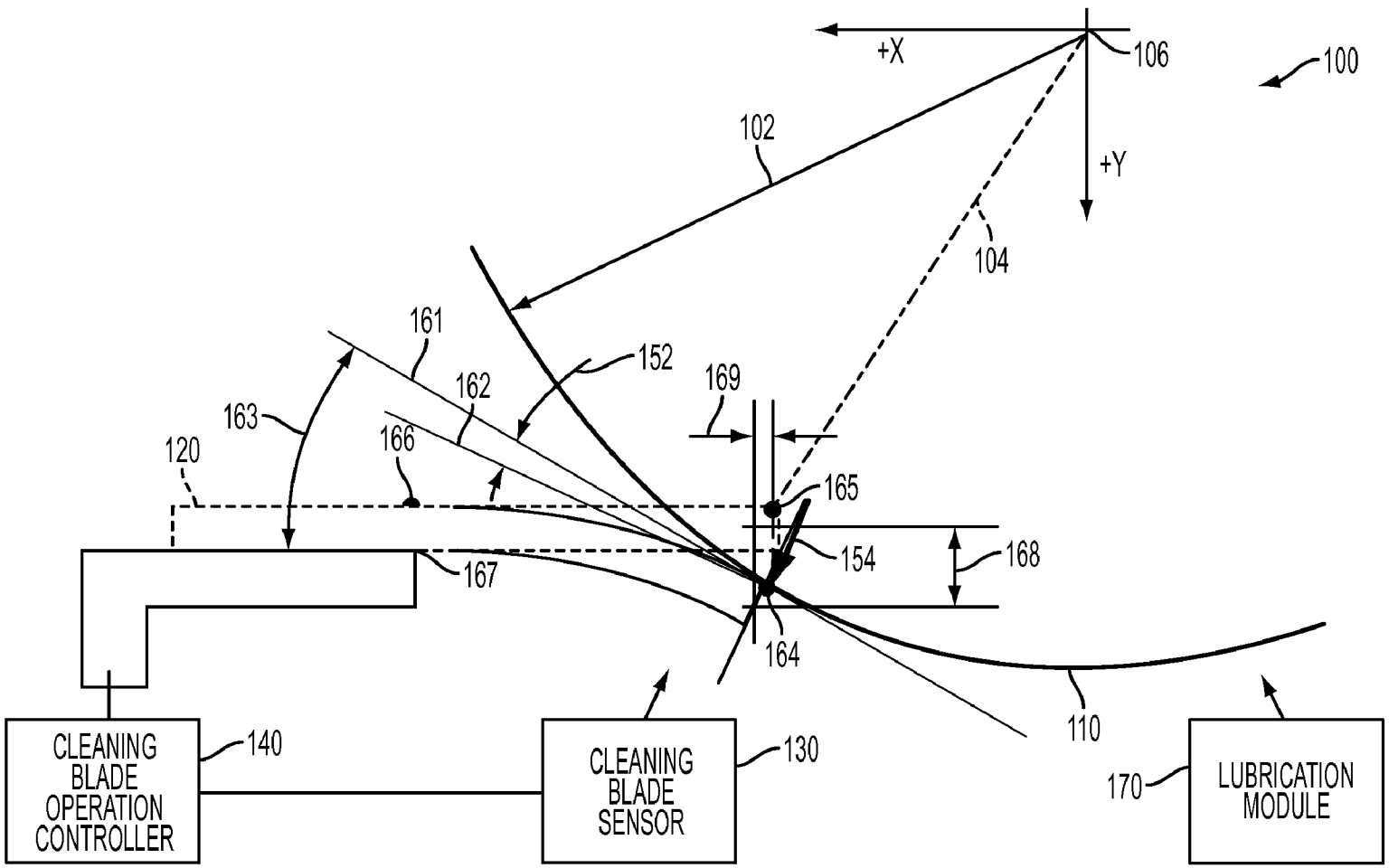
FIG. 1 is an exemplary illustration of an apparatus according to a possible embodiment.

FIG. 1 is an exemplary illustration of an apparatus 100 according to a possible embodiment. The apparatus 100 may be part of a printer, such as a multifunction media device, a xerographic machine, a laser printer, an ink jet printer, or any other device that generates an image on media. The apparatus 100 can include a printer rotational transport assembly 110 configured to transport a substance in a printer. The printer rotational transport assembly 110 can be a roll, a belt, a drum, an intermediate belt, an imaging drum, a transfer belt, a photoreceptor, or any other rotational assembly that can transport an image, a fluid, toner, metering fluid, particles, or any other substance in a printer. The apparatus 100 can include a cleaning blade 120 coupled to the printer rotational transport assembly 110. The cleaning blade 120 can be a metering blade, a cleaning blade, or any other blade that can meter or remove a substance or material from a printer rotational transport assembly. For example, a cleaning blade can remove toner from a photoreceptor or meter a lubrication fluid on a photoreceptor, a roll, or a belt.

The apparatus 100 can include a cleaning blade sensor 130 coupled to the cleaning blade 120. The cleaning blade sensor 130 can be configured to sense cleaning blade stress condition information. The cleaning blade sensor 130 can be a strain gauge, a torque sensor, a motor drive current sensor, an audio sensor, a vibration sensor, an optical sensor, or any other sensor useful for sensing cleaning blade stress condition information. A vibration sensor can be an accelerometer or can be a sensor configured to audibly sense vibration of the cleaning blade 120. The cleaning blade sensor 130 can be configured to sense cleaning blade stress condition information that includes high frequency cleaning blade variation. For example, high frequency cleaning blade variation can be caused by frictional stick-slip interaction between the cleaning blade 120 and the surface of the printer rotational transport assembly 110.

The apparatus 100 can include a controller 140 coupled to the cleaning blade 120 and the cleaning blade sensor 130. The controller 140 can be configured to adjust cleaning blade parameters of operation based on the sensed cleaning blade stress condition information. The controller 140 can include or can be coupled to an actuator that is coupled to the cleaning blade, where the actuator can provide a physical implementation of the adjustment to the cleaning blade parameters of operation. The cleaning blade sensor 130 can sense cleaning blade stress condition information and the controller 140 can adjust cleaning blade parameters of operation during run time operation. The controller 140 can be configured to adjust cleaning blade parameters of operation that reduce cleaning blade operation stress based on the sensed cleaning blade stress condition information. The controller 140 can also be configured to adjust cleaning blade parameters of operation based on the sensed cleaning blade stress condition information to reduce high frequency cleaning blade variation. The controller 140 can additionally be configured to adjust cleaning blade parameters of operation based on the sensed cleaning blade stress condition information from operation of the printer rotational transport assembly 110 at a speed lower than normal operation. The controller 140 can also be configured to adjust cleaning blade parameters of operation based on the sensed cleaning blade stress condition information sensed over multiple measurement cycles to dynamically adjust the cleaning blade parameters of operation on the fly.

The cleaning blade 120 can be coupled to the printer rotational transport assembly 110 at a cleaning blade working angle 152 and the cleaning blade parameters of operation can include at least the cleaning blade working angle 152. The cleaning blade 120 can be coupled to the printer rotational transport assembly 110 with a cleaning blade normal force 154 and the cleaning blade parameters of operation can include at least the cleaning blade normal force 154.

The apparatus 100 can include a printer rotational transport assembly lubrication module 170 configured to apply lubrication to the printer rotational transport assembly 110. The cleaning blade parameters of operation can include parameters of lubrication of the printer rotational transport assembly 110. For example, parameters of lubrication of the printer rotational transport assembly 110 can include an amount of lubrication, a frequency of lubrication, and/or a location of lubrication on the printer rotational transport assembly 110. The printer rotational transport assembly lubrication module 170 can be an independent lubrication module or can be part of a development or marking system. The printer rotational transport assembly lubrication module 170 can be configured to apply lubrication to the printer rotational transport assembly 110 after given sensed cleaning blade stress condition information exceeds a threshold. For example, the lubrication may not be applied until a high frequency amplitude of cleaning blade operation exceeds a threshold. The printer rotational transport assembly lubrication module 170 can be a toner stripe lubrication module configured to apply toner stripe lubrication to the printer rotational transport assembly 110. The cleaning blade parameters of operation can include toner stripe frequency of application to the printer rotational transport assembly 110, amount of toner stripe applied to the printer rotational transport assembly 110, and/or toner stripe application location on the printer rotational transport assembly 110.

According to a related embodiment, the apparatus 100 can include a printer rotational transport assembly 110 configured to transport a substance in a printer. The rotational transport assembly can be located a distance 102 from a reference point 106. The apparatus 100 can include a cleaning blade 120 coupled to the printer rotational transport assembly 110, where the cleaning blade 120 can be configured to remove at least a portion of the substance from the printer rotational transport assembly 110. The apparatus 100 can include a cleaning blade sensor 130 coupled to the cleaning blade 120, where the cleaning blade sensor 130 can be configured to sense high frequency cleaning blade variation. The apparatus 100 can include a cleaning blade operation controller 140 coupled to the cleaning blade 120 and the cleaning blade sensor 130. The cleaning blade operation controller 140 can be configured to adjust cleaning blade parameters of operation based on the sensed high frequency cleaning blade variation to reduce the high frequency cleaning blade variation. The cleaning blade parameters of operation can include a cleaning blade working angle 152, a cleaning blade normal force 154, parameters of lubrication of the printer rotational transport assembly 110, or other parameters of operation that can reduce the high frequency cleaning blade variation. Cleaning blade parameters of operation can also include or be related to the line of tangency 161 to the printer rotational transport assembly 110 at the point where the cleaning blade 120 contacts the printer rotational transport assembly 110, can include a line of tangency 162 to the blade tip 164 and a corresponding perpendicular line, can include an angle 163 between a blade holder and the line of tangency 161, can include the tip 164 of the deflected blade, can include the theoretical tip 165 of the undeflected blade at a distance 104 from the reference point 106, can include the top of the blade 166 at the end of a blade holder, can include a top of a blade holder end 167, can include a deflection of the blade 168, can include an apparent shortening of the blade length 169, and can include any other parameter of operation of a cleaning blade.

Figure 2:
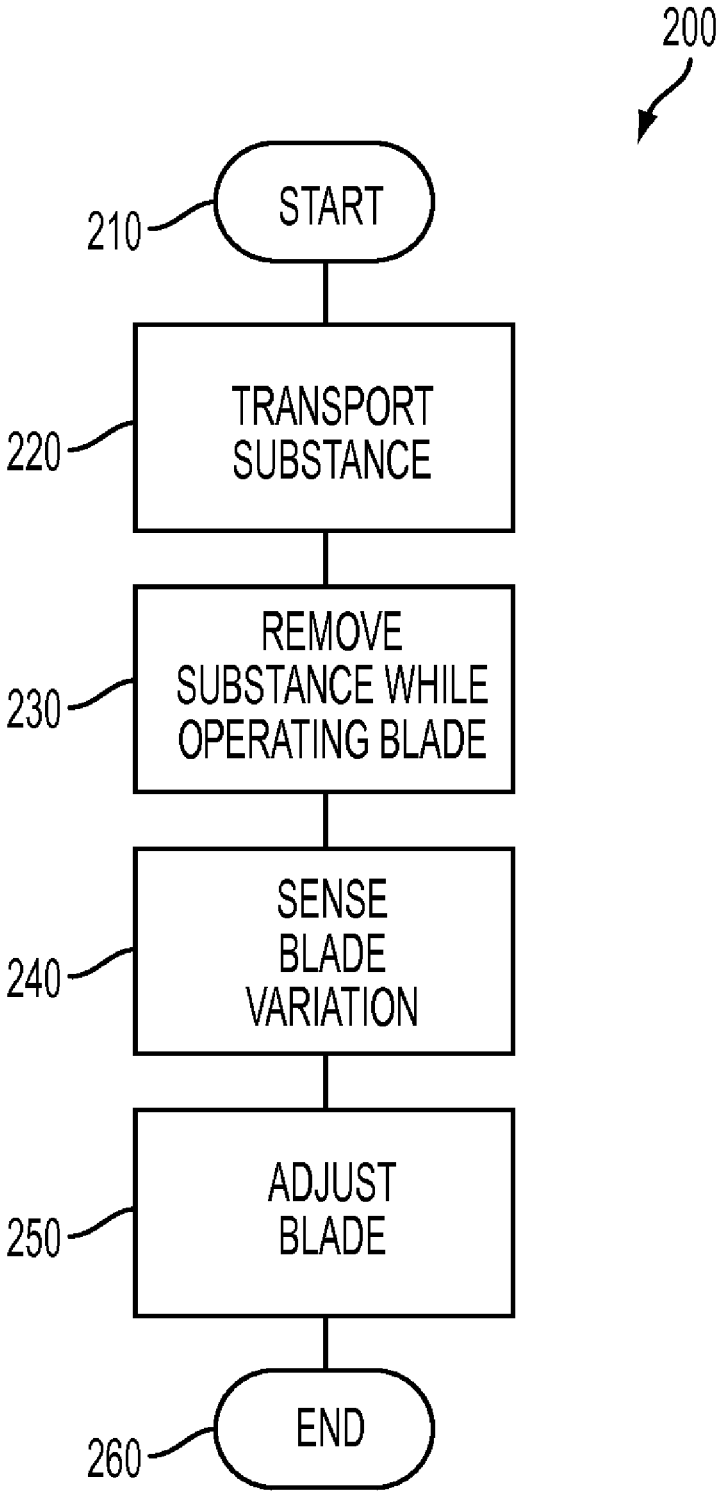
FIG. 2 is an exemplary flowchart of a method according to a possible embodiment.

FIG. 2 illustrates an exemplary flowchart 200 of a method in an apparatus having a printer rotational transport assembly configured to transport a substance in a printer and a cleaning blade coupled to the printer rotational transport assembly, where the cleaning blade can be configured to remove a substance from the printer rotational transport assembly. The method starts at 210. At 220, a substance is transported on a surface of the printer rotational transport assembly. For example, toner can be transported on a surface of a xerographic photoreceptor drum, metering fluid can be transported on a surface of a toner to paper fusing roll, lubrication can be applied to and transported on an imaging drum in a ink jet marking module, toner stripe lubrication can be applied to and transported on a photoreceptor belt, or any other substance useful in printing can be transported on a surface of the printer rotational transport assembly.

At 230, at least a portion of the substance is removed from the printer rotational transport assembly surface using the cleaning blade. The substance can be removed while operating the cleaning blade at a cleaning blade working angle relative to the printer rotational transport assembly surface. The substance can be removed while operating the cleaning blade at a cleaning blade normal force against the printer rotational transport assembly surface.

At 240, cleaning blade stress condition information is sensed. The cleaning blade stress condition information can be high frequency cleaning blade variation. At 250, cleaning blade parameters of operation are adjusted based on the sensed cleaning blade stress condition information. For example, the cleaning blade working angle can be adjusted based on the sensed cleaning blade stress condition information. Also, the cleaning blade normal force can be adjusted based on the sensed cleaning blade stress condition information. Additionally, lubrication can be applied to the printer rotational transport assembly after given sensed cleaning blade stress condition information exceeds a threshold. Cleaning blade stress conditions can also be reduced by adjusting toner stripe frequency of application to the printer rotational transport assembly, by adjusting an amount of toner stripe applied to the printer rotational transport assembly, by adjusting toner stripe application location on the printer rotational transport assembly, or by adjusting other elements of cleaning blade operation. At 260, the method ends.

Figure 3:
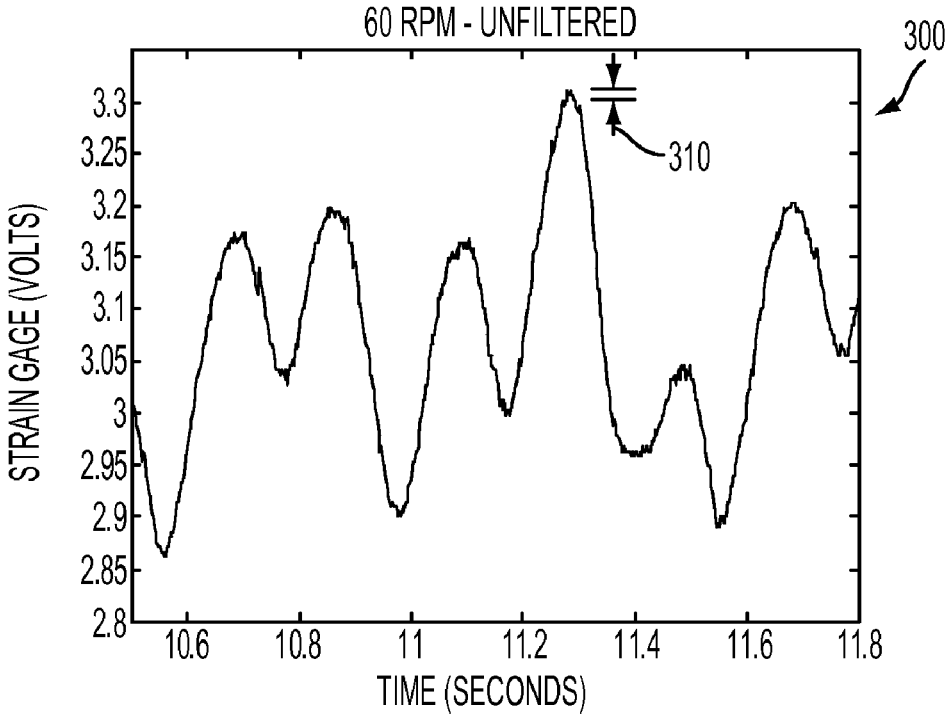
FIG. 3 is an exemplary graph illustrating an output of a cleaning blade sensor according to a possible embodiment.
Figure 4:
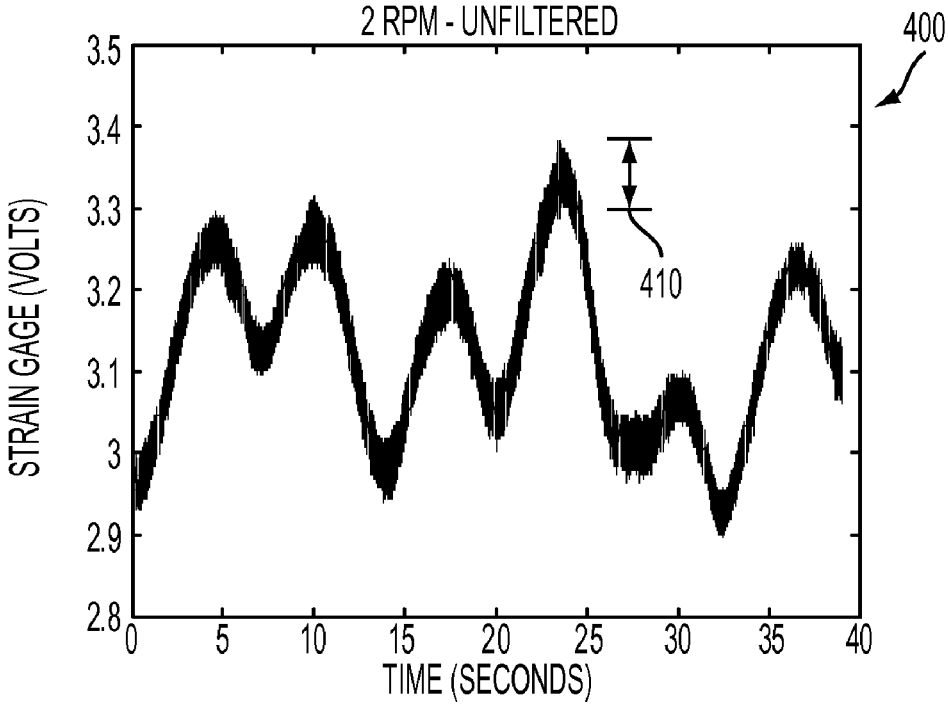
FIG. 4 is an exemplary graph illustrating an output of a cleaning blade sensor according to a possible embodiment.

FIG. 3 is an exemplary graph 300 illustrating an output of a cleaning blade sensor 130 on a printer rotational transport assembly 110 operating at 60 revolutions per minute according to a possible embodiment. FIG. 4 is an exemplary graph 400 illustrating an output of a cleaning blade sensor 130 on a printer rotational transport assembly 110 operating at 2 revolutions per minute according to a possible embodiment. To generate the graphs 300 and 400, two pairs of strain gages were used as sensors by mounting them to top and bottom sides of a cleaning blade assembly 120. Using a signal conditioner, the voltage across a resistor bridge created by the two sets of gages was acquired while the blade 120 was in operation to monitor stress and/or strain on the blade 120. The graphs 300 and 400 illustrate a representative scan of the voltage response for one revolution of an 84 mm photoreceptor, such as the printer rotational transport assembly 110, at two different rotational speeds. The scan pattern can be characteristic of an individual photoreceptor and it can repeat reliably every photoreceptor cycle. As the speed of the photoreceptor reduces, the slick-slip nature of the blade edge becomes very evident in the voltage signal. The low frequency variation in the signal can be due to photoreceptor and bearing run out. The high frequency portion 310 and 410 is due to the sticking and slipping of the blade edge or tip 164 on the photoreceptor surface. The high frequency signal related to the magnitude of the frictional stick-slip interaction between the cleaning blade tip and the photoreceptor surface can be separated from the low frequency signal through well known frequency transform based or equivalent convolution based signal processing techniques.

A toner lube stripe can reduce the high frequency variation by reducing the tendency of the stick-slip phenomenon. The detection of the high frequency stick-slip phenomenon can offer the ability to sense and control the toner lubrication strategy to minimize toner usage, while maximizing the blade 120 life. While this example uses strain gages to sense the high frequency stick-slip, a torque transducer, a current sensing circuit for a drum drive motor, a blade assembly mounted accelerometer, or other vibration detection sensor, or even an audio transducer can offer a similar signal as feedback.

In a control strategy, the cleaning blade operation controller 140 can use the feedback signal to sense when the stick-slip reaches a stored amplitude threshold. The cleaning blade operation controller 140 can instruct the lubrication module 170 to put a toner lube stripe on the printer rotational transport assembly 110 to reduce or eliminate the high frequency stick-slip. The feedback signal can prevent putting down lube stripes too often as they are only put down when needed, which can save toner consumption, while keeping the blade edge stable for long life. In addition, since the amount of required lubrication can vary significantly based on a multitude of environmental and customer usage factors, this strategy can also ensure that more robust cleaning blade life is achieved through maintenance of sufficient blade lubrication across all noise factors.

The lubrication of the blade/printer rotational transport assembly 110 can vary significantly over a printer rotational transport assembly revolution. Thus, the sensing strategy for adjustment of blade lubrication/friction can measure across one or more photoreceptor revolutions. One simple implementation strategy can take the average or even can take the worst-case scenario over the entire printer rotational transport assembly revolution. Other, more advanced, strategies can also be utilized.

There are several possibilities of when the measurements of blade/printer rotational transport assembly friction can be taken. One can be to measure the stick-slip interaction between the blade 120 and the printer rotational transport assembly 110 during cycle-up and cycle-down. During these speed transitions, the printer rotational transport assembly 110 can operate for a short period at low speeds. These reduced speeds can enhance the stick-slip interaction, thereby improving signal-to-noise ratio for the sensing method. The information obtained from these measurements can then be used to make adjustments to the lubrication strategy, such as how often lube stripes are put down and how large the stripes are. Another possible implementation strategy can be to run periodic diagnostic routines that can spin the printer rotational transport assembly 110 at a reduced speed, which can enhance the stick-slip signal to be measured.

Several possible implementations can be used for the feedback algorithm adjusting blade lubrication as a function of the measured blade friction. One example is to not put down any lubrication stripes until the measured stick/slip amplitude has reached a predetermined level or threshold. Another possible implementation can be to determine the required size and/or frequency of, or period between, the lubrication stripes based on the measured blade friction. One general form for a possible set of algorithms for these types of approaches is given below:

$$L_{period}(k)=\alpha_0 X_{friction}(k)+\ldots+\alpha_N X_{friction}(k-M)$$

$$L_{width}(k)=\beta_0 X_{friction}(k)+\ldots+\beta_N X_{friction}(k-N)$$

where k represents the sampling instant, $L_{period}$ and $L_{width}$ represent the period and width of the lube stripes, $X_{friction}$ represents the measured blade friction, M and N represent the chosen number of terms, and $\alpha$ and $\beta$ represent the coefficients to be chosen to give the desired dynamic response. Through appropriate choice of the $\alpha$ and $\beta$ coefficients, filtering of the measured signal $X_{friction}$ can be introduced into the system. This can help prevent over-response of the lubrication parameters from potentially noisy friction measurements. Any number of other algorithms can also be used and these are simply meant as illustrative examples.

In addition to a toner lubrication stripe, modification of the blade setup parameters, such as blade working angle and normal force, can also provide a reduction in stick-slip against the surface of the printer rotational transport assembly 110. The settings can be adjusted throughout the life of the blade 120, and can use a dynamic setup strategy. Using the feedback cleaning blade sensor signal described above, the high frequency variation seen at low speeds from stick-slip can be used to dynamically adjust the blade setting to minimize blade edge stress from stick-slip. The cleaning blade hardware can be built to have the ability to change the set angle or interference on the fly in order to adjust blade load or working angle. This adjustment can keep the blade edge from running in an excessive friction condition and can ensure longer life cleaning stability.

As mentioned above, possible implementation strategy can be to measure the stick-slip interaction between the blade and the printer rotational transport assembly 110 during cycle-up and cycle-down. During these speed transitions, the printer rotational transport assembly 110 can operate for a short period at low speeds. These reduced speeds can enhance the stick-slip interaction. The information obtained from the sensor measurements can be used to make adjustments to the blade setup parameters, such as blade load and blade setup angle.

Another possible implementation can involve running periodic diagnostic routines that can spin the printer rotational transport assembly 110 at a reduced speed, which can enhance the stick-slip signal to be measured. The period of time required for the measurement can be very small, as the signal of interest is high frequency. Thus, the required time for the diagnostic routines can be quite short, such as much less than 1 second.

In terms of the feedback algorithm for adjustment of the blade normal force and/or blade working angle, a variety of implementations can be used. One approach can be to simply adjust these parameters to minimize the amplitude of the measured high frequency stick/slip friction during each measurement cycle. As long as the relationship between the two setup parameters and the amplitude of the stick-slip interaction is monotonic, such an approach can be simple, for example, by driving the adjustment in one direction until the desired amplitude threshold criteria is met.

An alternative implementation can be to dynamically adjust the blade parameters on-the-fly based on multiple measurement cycles. A simple example of such an approach can be as follows:

$$B_{angle}(k)=\alpha_{A1}B_{angle}(k-1)+\alpha_{AM}B_{angle}(k-M)+\beta_{A0}X_{friction}(k)+\ldots+\beta_{AN}X_{friction}(k-N)$$

$$B_{normF}(k)=\alpha_{B1}B_{normF}(k-1)+\alpha_{BM}B_{normF}(k-M)+\beta_{B0}X_{friction}(k)+\ldots+\beta_{BN}X_{friction}(k-N)$$

where k represents the sampling instant, $B_{angle}$ and $B_{normF}$ represent the blade working angle and blade normal force, $X_{friction}$ represents the measured blade friction, M and N represent the chosen number of terms, and $\alpha$ and $\beta$ represent the coefficients to be chosen to give the desired dynamic response. Through appropriate choice of the $\alpha$ and $\beta$ coefficients, filtering of the measured signal $X_{friction}$ can be introduced into the system. This can help to prevent over-response of the blade setup parameters due to potentially noisy friction measurements. In another embodiment, an automated in situ design of experiment can be performed where setup parameters such as normal force and working angle, can be used as the factors and the high frequency friction signal can be used as the response. The system can make measurements, then produce a regression model, and then choose parameter levels which minimize the high frequency response. Any number of other algorithms can also be used and these are simply meant as illustrative examples.

Figure 5:
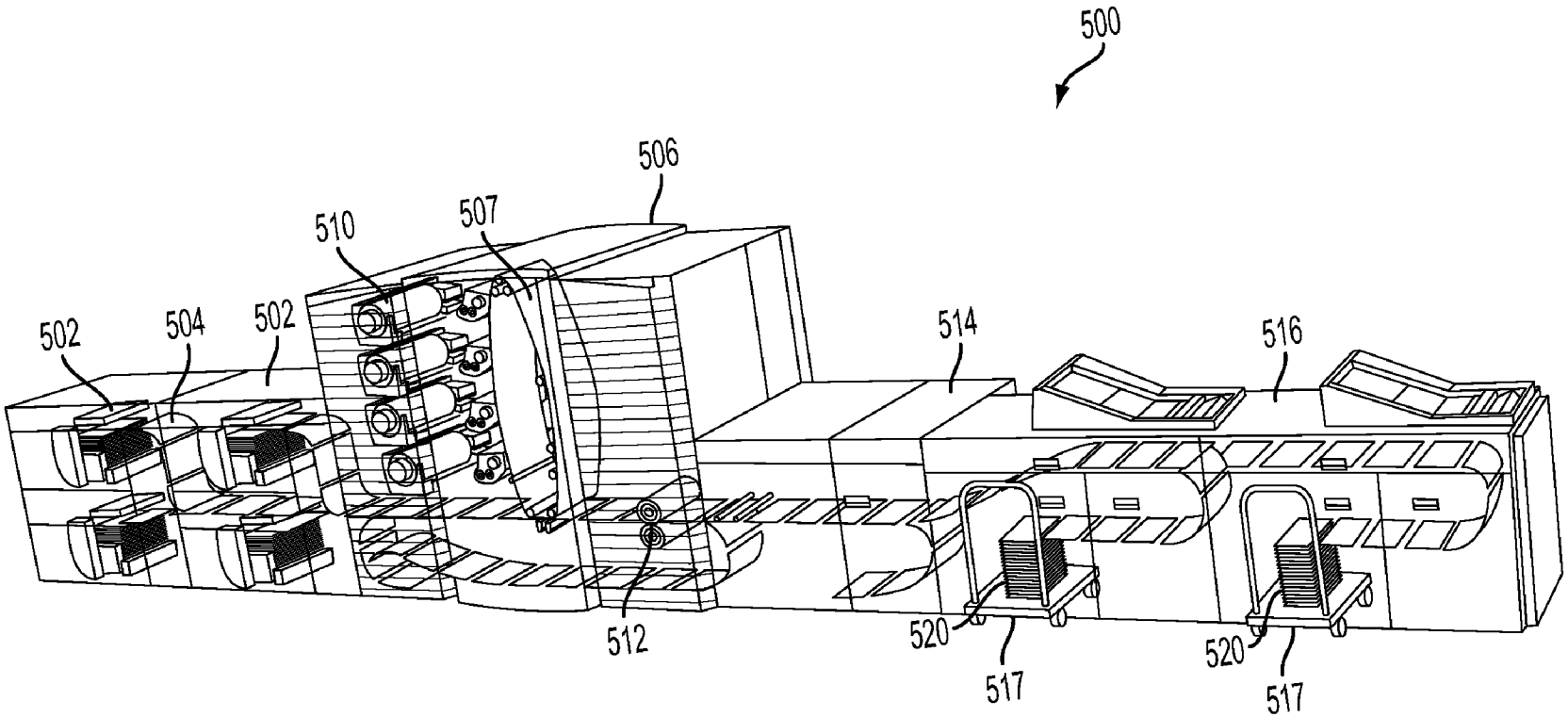
FIG. 5 illustrates an exemplary printing apparatus according to a possible embodiment.

FIG. 5 illustrates an exemplary printing apparatus 500, in which cleaning blade adjustment such as the apparatus 100 can be employed. As used herein, the term "printing apparatus" encompasses any apparatus, such as a digital copier, bookmaking machine, multifunction machine, and other printing devices that perform a print outputting function for any purpose. The printing apparatus 500 can be used to produce prints from various media, such as coated, uncoated, previously marked, or plain paper sheets. The media can have various sizes and weights. In some embodiments, the printing apparatus 500 can have a modular construction. As shown, the printing apparatus 500 can include at least one media feeder module 502, a printer module 506 adjacent the media feeder module 502, an inverter module 514 adjacent the printer module 506, and at least one stacker module 516 adjacent the inverter module 514.

In the printing apparatus 500, the media feeder module 502 can be adapted to feed media 504 having various sizes, widths, lengths, and weights to the printer module 506. In the printer module 506, toner is transferred from an arrangement of developer stations 510 to a charged photoreceptor belt 507 to form toner images on the photoreceptor belt 507. According to one embodiment, the printer rotational transport assembly 110 from the apparatus 100 can be the photoreceptor belt 507. The toner images are transferred to the media 504 fed through a paper path. The media 504 are advanced through a fuser 512 adapted to fuse the toner images on the media 504. The inverter module 514 manipulates the media 504 exiting the printer module 506 by either passing the media 504 through to the stacker module 516, or by inverting and returning the media 504 to the printer module 506. In the stacker module 516, printed media are loaded onto stacker carts 517 to form stacks 520.

Embodiments can provide for a sensing technique to optimize the lubrication of a blade edge to ensure cleaning blade longevity. A blade sensor can be used to detect the occurrence of high stress, high frequency stick-slip motion of a blade edge across a printer rotational transport assembly surface. Toner lubrication stripe frequency and location can then be optimized to minimize the occurrence of high stress conditions. Ensuring that the blade edge remains well lubricated can minimize blade wear which can allow the blade to perform successfully with a longer life.

Embodiments can also provide for a sensing technique to optimize critical parameters of a cleaning blade to ensure cleaning edge longevity. A sensor can be used to detect the occurrence of high stress, high frequency stick-slip motion of the blade edge across a photoreceptor surface. The blade working angle and/or normal force can then be adjusted to reduce high blade stress by minimizing stick-slip motion. Minimization of blade wear by ensuring that the blade edge operates in low stress conditions can enable the blade to perform successfully with a longer life.

Embodiments can provide for a cleaning blade lubrication control system based on sensing a high frequency stick-slip friction signal using a strain gage mounted on a cleaning blade, using torque sensing, using motor current sensing, using vibration sensing, using audio sensing, or using other sensing techniques. Embodiments can provide for longer life cleaning blades, can provide more robust/reliable cleaning blade performance in spite of potentially wide variations in operational noise factors, and can provide for minimized toner consumption for cleaning blade lubrication.

Embodiments may preferably be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure. Additionally, embodiments may be implemented using analog electronics, such as op-amps, filters, and other analog electronics.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. An apparatus comprising:

a printer rotational transport assembly configured to transport a substance in a printer;

a cleaning blade coupled to the printer rotational transport assembly;

a cleaning blade sensor coupled to the cleaning blade, the cleaning blade sensor configured to sense cleaning blade stress condition information; and a controller coupled to the cleaning blade and the cleaning blade sensor, the controller configured to adjust cleaning blade parameters of operation based on the sensed cleaning blade stress condition information, wherein the controller is configured to adjust cleaning blade parameters of operation based on the sensed cleaning blade stress condition information sensed over multiple measurement cycles and based on past and current values of cleaning blade parameters of operation to dynamically adjust the cleaning blade parameters of operation on the fly.

2. The apparatus according to claim 1, wherein the controller is configured to adjust cleaning blade parameters of operation that reduce cleaning blade operation stress based on the sensed cleaning blade stress condition information.

3. The apparatus according to claim 1, wherein the cleaning blade is coupled to the printer rotational transport assembly at a cleaning blade working angle, and wherein the cleaning blade parameters of operation comprise at least the cleaning blade working angle.

4. The apparatus according to claim 1, wherein the cleaning blade is coupled to the printer rotational transport assembly with a cleaning blade normal force, and wherein the cleaning blade parameters of operation comprise at least the cleaning blade normal force.

5. The apparatus according to claim 1, further comprising a printer rotational transport assembly lubrication module configured to apply lubrication to the printer rotational transport assembly, wherein the cleaning blade parameters of operation comprise parameters of lubrication of the printer rotational transport assembly.

6. The apparatus according to claim 5, wherein the printer rotational transport assembly lubrication module is configured to apply lubrication to the printer rotational transport assembly after given sensed cleaning blade stress condition information exceeds a threshold.

7. The apparatus according to claim 1, further comprising a toner stripe lubrication module configured to apply toner stripe lubrication to the printer rotational transport assembly, wherein the cleaning blade parameters of operation comprise at least one of toner stripe frequency of application to the printer rotational transport assembly, amount of toner stripe applied to the printer rotational transport assembly, and toner stripe application location on the printer rotational transport assembly.

8. The apparatus according to claim 1, wherein the cleaning blade sensor is configured to sense cleaning blade stress condition information that includes high frequency cleaning blade variation.

9. The apparatus according to claim 1, wherein the controller is configured to adjust cleaning blade parameters of operation based on the sensed cleaning blade stress condition information to reduce high frequency cleaning blade variation.

10. The apparatus according to claim 1, wherein the controller is configured to adjust cleaning blade parameters of operation based on the sensed cleaning blade stress condition information from operation of the printer rotational transport assembly at a speed lower than normal operation.

11. The apparatus according to claim 1, wherein the cleaning blade sensor comprises at least one of a strain gauge, a torque sensor, a motor drive current sensor, an audio sensor, an optical sensor, and a vibration sensor.

12. A method in an apparatus including a printer rotational transport assembly configured to transport a substance in a printer and a cleaning blade coupled to the printer rotational transport assembly, the cleaning blade configured to remove a substance from the printer rotational transport assembly, the method comprising:

transporting a substance on a surface of the printer rotational transport assembly;

removing at least a portion of the substance from the printer rotational transport assembly surface using the cleaning blade;

sensing cleaning blade stress condition information; and adjusting at least one cleaning blade parameter of operation based on the sensed cleaning blade stress condition information, wherein adjusting comprises adjusting cleaning blade parameters of operation based on the sensed cleaning blade stress condition information sensed over multiple measurement cycles and based on past and current values of cleaning blade parameters of operation to dynamically adjust the cleaning blade parameters of operation on the fly.

13. The method according to claim 12, further comprising operating the cleaning blade at a cleaning blade working angle relative to the printer rotational transport assembly surface, wherein adjusting comprises adjusting the cleaning blade working angle based on the sensed cleaning blade stress condition information.

14. The method according to claim 12, further comprising operating the cleaning blade at a cleaning blade normal force relative to the printer rotational transport assembly surface, wherein adjusting comprises adjusting the cleaning blade normal force based on the sensed cleaning blade stress condition information.

15. The method according to claim 12, further comprising, wherein adjusting comprises applying lubrication to the printer rotational transport assembly after sensed cleaning blade stress condition information exceeds a threshold.

16. The method according to claim 12, further comprising applying toner stripe lubrication to the printer rotational transport assembly, wherein adjusting comprises adjusting at least one of toner stripe frequency of application to the printer rotational transport assembly, amount of toner stripe applied to the printer rotational transport assembly, and toner stripe application location on the printer rotational transport assembly.

17. The method according to claim 12, wherein cleaning blade stress condition information comprises high frequency cleaning blade variation.

18. An apparatus comprising:

a printer rotational transport assembly configured to transport a substance in a printer;

a cleaning blade coupled to the printer rotational transport assembly, the cleaning blade configured to remove at least a portion of the substance from the printer rotational transport assembly;

a cleaning blade sensor coupled to the cleaning blade, the cleaning blade sensor configured to sense high frequency cleaning blade variation; and a cleaning blade operation controller coupled to the cleaning blade and coupled to the cleaning blade sensor, the cleaning blade operation controller configured to adjust cleaning blade parameters of operation based on the sensed high frequency cleaning blade variation to reduce the high frequency cleaning blade variation, wherein the cleaning blade operation controller is configured to adjust cleaning blade parameters of operation based on the sensed high frequency cleaning blade variation sensed over multiple measurement cycles and based on past and current values of cleaning blade parameters of operation to dynamically adjust the cleaning blade parameters of operation on the fly.

19. The apparatus according to claim 18, wherein the cleaning blade parameters of operation comprise at least one of a cleaning blade working angle, a cleaning blade normal force, and parameters of lubrication of the printer rotational transport assembly.

* * * * *